US008151981B2

(12) United States Patent
Nordstrom

(10) Patent No.: US 8,151,981 B2
(45) Date of Patent: Apr. 10, 2012

(54) RETRIEVAL DEVICE FOR USE WITH A COMPARTMENT OR POCKET

(75) Inventor: Mark Nordstrom, Brentwood, TN (US)

(73) Assignee: Genesco, Inc., Nashville, TN (US)

( * ) Notice: Subject to any disclaimer, the term of this patent is extended or adjusted under 35 U.S.C. 154(b) by 25 days.

(21) Appl. No.: 12/922,545

(22) PCT Filed: Mar. 16, 2009

(86) PCT No.: PCT/US2009/037297

§ 371 (c)(1),
(2), (4) Date: Sep. 14, 2010

(87) PCT Pub. No.: WO2009/114858

PCT Pub. Date: Sep. 17, 2009

(65) Prior Publication Data

US 2011/0011754 A1 Jan. 20, 2011

Related U.S. Application Data

(60) Provisional application No. 61/036,764, filed on Mar. 14, 2008.

(51) Int. Cl.
*A45C 15/00* (2006.01)

(52) U.S. Cl. ..... 206/38; 206/254; 206/255; 206/804

(58) Field of Classification Search ..... 206/38, 206/249, 254, 255, 39.4, 39.5, 39.6, 804, 206/817, 320; 224/196; 221/251, 268, 271, 221/185, 282; 150/116
See application file for complete search history.

(56) References Cited

U.S. PATENT DOCUMENTS

| | | | | |
|---|---|---|---|---|
| 628,164 | A | 7/1899 | See | |
| 1,206,124 | A * | 11/1916 | Meyers | 206/254 |
| 1,344,635 | A * | 6/1920 | Hill | 206/259 |
| 1,463,619 | A * | 7/1923 | Gardner | 206/39.4 |

(Continued)

FOREIGN PATENT DOCUMENTS

WO WO-2009114858 9/2009

(Continued)

OTHER PUBLICATIONS

"International Application Serial No. PCT/US2009/037297, International Preliminary Report on Patentability, mailed Sep. 23, 2010".

(Continued)

*Primary Examiner* — David Fidei
(74) *Attorney, Agent, or Firm* — Kilpatrick Townsend & Stockton LLP

(57) ABSTRACT

The present invention is related to an apparatus to facilitate the retrieval of a personal device from a compartment or pocket. The apparatus has a back surface with a support attached to the back surface in a manner that allows the support to move and a tab or loop on one end of the support. An elastic tape is attached to the back surface and to the support. Also attached to the support is a ribbon which is secured to the elastic tape at a connection point. The support can be extended to retrieve the personal device from the compartment or pocket which stretches the elastic tape and the ribbon until the ribbon is fully extended preventing the further extension of the support. The elastic tape may then facilitate the retraction of the apparatus into the compartment or pocket.

16 Claims, 3 Drawing Sheets

U.S. PATENT DOCUMENTS

| | | | | |
|---|---|---|---|---|
| 2,061,293 | A * | 11/1936 | Stember | 150/116 |
| 3,589,505 | A * | 6/1971 | Burniski | 206/250 |
| 4,541,556 | A * | 9/1985 | Collins et al. | 224/196 |
| 6,305,540 | B1 * | 10/2001 | Crawford et al. | 206/320 |
| 6,935,497 | B1 | 8/2005 | Domotor et al. | |
| 6,948,600 | B2 | 9/2005 | Chuang | |
| 2003/0029754 | A1 * | 2/2003 | Scicluna | 206/320 |
| 2004/0134734 | A1 | 7/2004 | Hollingsworth et al. | |
| 2005/0241972 | A1 | 11/2005 | Hassett et al. | |
| 2008/0035506 | A1 | 2/2008 | Rostami | |
| 2008/0277436 | A1 * | 11/2008 | Wilson | 224/239 |

FOREIGN PATENT DOCUMENTS

| | | | |
|---|---|---|---|
| WO | WO-2009114858 | A3 | 12/2009 |

OTHER PUBLICATIONS

"International Application Serial No. PCT/US2009/037297, International Search Report mailed May 26, 2009".

"International Application Serial No. PCT/US2009/037297, International Written Opinion mailed May 26, 2009".

* cited by examiner

RETRIEVAL DEVICE FOR USE WITH A COMPARTMENT OR POCKET

PRIOR RELATED APPLICATIONS

This application is a national phase of PCT/US2009/037297 filed Mar. 16, 2009 which claims priority to U.S. Provisional Patent Application Number 61/036,764 filed Mar. 14, 2008, both of which are incorporated by reference herein in their entirety.

CROSS-REFERENCE TO RELATED APPLICATIONS

This application claims the benefit of U.S. Provisional Patent Application No. 61/036,764 filed Mar. 14, 2008, which is incorporated herein by reference in its entirety.

TECHNICAL FIELD

The present invention relates generally to an apparatus for storing handheld devices in pockets or compartments and retrieving those goods from the pockets or compartments using a retrieval device, and relates more specifically to an apparatus for securing handheld devices and personal devices in pockets or compartments and retrieving those goods from the pockets or compartments using a retrieval device which may be found in bags and/or cases.

BACKGROUND

Individuals often carry handheld type devices including cell phones, Blackberries®, IPods®, wallets, and other personal devices while performing their day-to-day activities. These devices are sometimes carried in their hands or clothing pockets and sometimes in handbags and briefcases. Handbags and briefcases have a variety of storage areas including the main compartments which are often large and comprise most of the space available for storage. The main compartments are generally meant to serve the primary purpose of the bag or case, which is to carry goods of appropriate size that will fit in the compartment. For example, the main compartment of a briefcase is often used to store paper or laptops.

Bags and cases often have a variety of smaller compartments. These smaller compartments are typically used to hold smaller personal devices in order to make them easier to locate. Placing smaller devices in a main compartment of a bag or case may cause those devices to be unnecessarily shaken or damaged by other objects located in the larger compartments. These other objects may include much larger and heavier devices as well as keys or other sharp objects that could potentially damage the smaller personal devices. The large compartments also allow the small personal devices to move from side to side which may make them difficult to locate. Smaller compartments that are capable of holding one item or a group of smaller devices of appropriate shape and size may make them less likely to be damaged and easier to locate.

Many modern handbags and briefcases have special compartments designed for particular personal devices or groups of personal devices. These compartments are a certain dimension in order to appropriately and safely store these devices. The size of the compartments vary based on the devices for which they have been designed. Some compartments allow the personal devices to remain uncovered when placed in them. Some compartments allow the personal devices to be secured with a clip, fastener, button or other apparatus for securing the item in the compartment. Some compartments have zippers. The compartments can be oriented in any direction that would fit the personal item and hold it securely. These compartments may be located anywhere on the bags and cases such as on the inside, under flaps, or on the outside. They may be single compartments or a variety of compartments holding various shapes and sizes of personal devices.

Some cases for storing personal devices are free-standing and not attached to bags or cases. These cases are often used to protect personal devices. The personal devices used with these free-standing cases are often electronics.

When retrieving these devices, the individual may be required to dig in the large compartments to retrieve his or her devices. Sometimes objects such as keys are placed with these devices and may damage them. For example, a key may scratch the outer surface of a cell phone or other electronic device. Thus, there is a need for a device to better organize personal devices, protect them, and facilitate their retrieval.

SUMMARY OF THE INVENTION

The present invention is related to an apparatus to facilitate the retrieval of a personal device from a compartment or pocket. The apparatus has a back surface with a support attached to the back surface in a manner that allows the support to move and a tab or loop on one end of the support. An elastic tape is attached to the back surface and to the support. Also attached to the support is a ribbon which is secured to the elastic tape at a connection point. The support can be extended to retrieve the personal device from the compartment or pocket which stretches the elastic tape and the ribbon until the ribbon is fully extended preventing the further extension of the support. The elastic tape may then facilitate the retraction of the apparatus into the compartment or pocket.

DETAILED DESCRIPTION OF THE DISCLOSED EMBODIMENT

Certain embodiments of the present invention provide a device for securing and retrieving personal devices from compartments or cases in a convenient manner. FIGS. 1-6 depict a personal organizer compartment and retrieval device according to certain embodiments of the invention.

Figure 1:
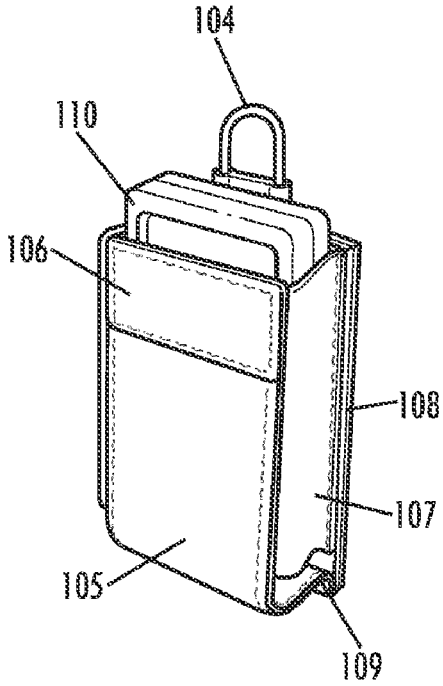
FIG. 1 is a front view of a personal organizer compartment in a relaxed state according to certain embodiments of the invention.
Figure 2:
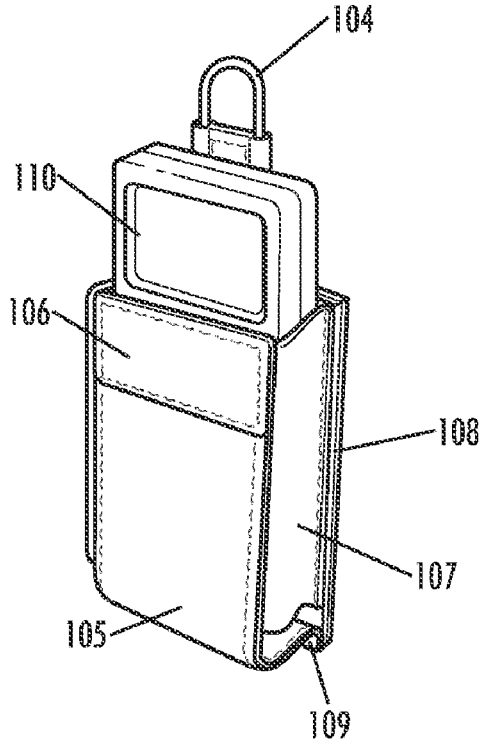
FIG. 2 is a front view of a personal organizer compartment mechanism in an extended state according to certain embodiments of the invention.

An embodiment of a personal organizer compartment in a relaxed state and an extended state is shown in FIGS. 1 and 2, respectively. The compartment may be generally rectangular based on the generally rectangular shape of most personal devices including electronic devices such as cell phones, IPods® and Blackberries®. However, it should be understood that the compartment can be any variety of shapes that would be appropriate to fit different shaped devices as desired. For example, a compartment created for a pen may have a cylindrical shape rather than a rectangular shape.

The rectangular compartment depicted in the drawings according to certain embodiments of the invention is created from Nylon Aerospacer, leather, and elastic tape. The compartment may be made from any of a variety of materials appropriate for such compartments including: leather, suede, synthetic material, elastomer, durable cloth, nylon, polyester, plastic, or any appropriate combination thereof.

A portion of the main body of the compartment in certain embodiments may be made from Aerospacer Nylon. Aerospacer Nylon is a material that is constructed with hydrofil nylon which has small air chambers within the outside layers. It is lightweight and dries quickly when exposed to water. However, any appropriate material for the compartment including those identified above can be used in place of the Aerospacer Nylon. The Aerospacer Nylon extends for the length of the back 108 of the compartment where the compartment may be attached to a bag or case. It is not necessary to attach this compartment to a bag or case as it can be carried independent from any bag or case.

A second piece of Aerospacer Nylon, or other suitable material for the compartment including but not limited to those described above, is attached 109 to the bottom of the first piece of material comprising the back of the compartment according to certain embodiments. The second piece of material is formed into the bottom and front 105 of the compartment at approximate 90° angles from the first section creating a generally rectangular compartment without three sides in an embodiment. In this embodiment, these two attached pieces when viewed from the side appear to form a squared "U" shape. Attachment of the materials to form the compartment are preferably sewn with nylon, polyester, or a poly-cotton thread but may also be attached by any adhesive, sonic welding, rivets, or mechanical fasteners that one of ordinary skill in the art would recognize may be used for this purpose. Throughout this application, attachments may be made through any of the above methods unless otherwise noted. In addition, this section of the compartment could be formed from one piece of appropriate material or more than two pieces of appropriate material generally arranged to form the front, bottom, and back of the compartment.

In certain embodiments, a rectangular leather strip 106 is attached to the Aerospacer Nylon at the top of the front of the formed compartment. This leather can be attached adjacent to the Aerospacer Nylon or suitable material as an extension upward or can be attached on top of the Aerospacer Nylon or suitable material creating two layers of material at the top of that section. The leather strip 106 may be inscribed or decorated if desired.

According to certain embodiments, elastic tape is attached to the Aerospacer Nylon (or suitable material) shell to form two sides 107 connecting the two pieces of Aerospacer Nylon (or suitable material) that comprise the front 105 and back 108 of the compartment. This forms a generally rectangular box with an open top as depicted in FIGS. 1 and 2. The width of the elastic tape determines the width of the compartment and can be of varying widths and lengths depending on the personal item with which the compartment will be used. Alternatively, the sides 107 can be formed of any of a number of suitable materials including: leather, suede, synthetic material, elastomer, durable cloth, nylon, polyester, plastic, or any appropriate combination thereof.

The sides 107 may extend the full length of the compartment from the bottom of the compartment to the top or they can be shorter in length and run only a portion of the height of the compartment. In an embodiment, the elastic tape or similar material allows some flexibility in the size of personal devices 110 that can be inserted into the compartments. Its flexibility also serves to allow for the compression of certain devices to secure them in the compartment. Secured to the compartment is a molded tab or loop 104 which may extend above the personal device 110 to facilitate removal.

Figure 3:
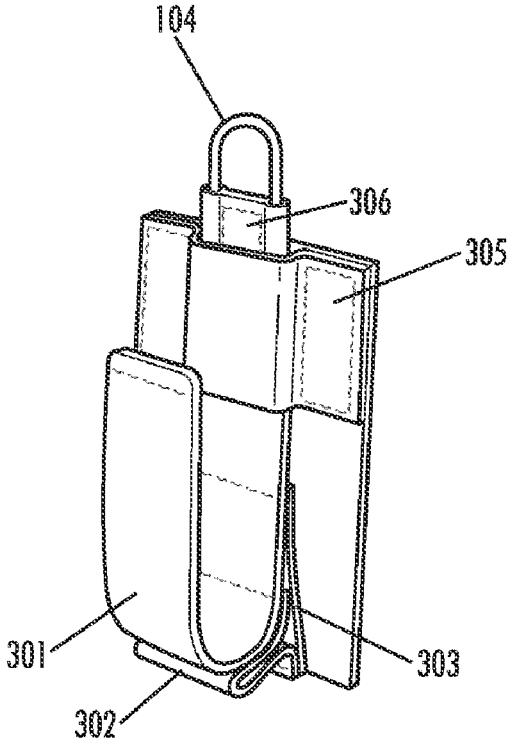
FIG. 3 is a front view of a personal organizer compartment mechanism in a relaxed state according to certain embodiments of the invention.
Figure 4:
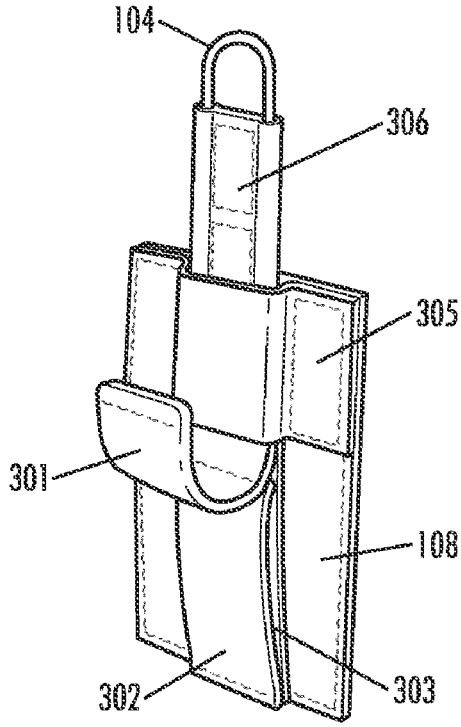
FIG. 4 is a front view of a personal organizer compartment in an extended state according to certain embodiments of the invention.

Secured to the back of the compartment is a personal item retrieval device. FIGS. 3 and 4 show certain embodiments as described above with the front compartment 105 and the leather section attached to the front compartment 106 removed so that the interior of the compartment can be viewed. FIG. 3 depicts the retrieval device in a relaxed state. FIG. 4 depicts the retrieval device in an extended state. In this embodiment, a Thermoplastic molded tab or loop 104 extends vertically from the back of the compartment. It extends above the compartment and at least slightly above the anticipated height of the personal item to be placed in the compartment. The loop or tab 104 is used to facilitate the retrieval of the personal device being stored. The loop or tab 104 may be made of leather, plastic, material, synthetic fibers, or any other suitable material. The loop or tab 104 is attached to the support by any of the suitable materials for the compartment. The loop or tab 104 can be grasped to facilitate removal of the personal devices and automatic retraction of the device into the compartment based on the mechanisms below.

The retrieval device may be secured to the back of the compartment by a suitable material 305 including: Aerospacer Nylon, leather, suede, synthetic material, Elastomer, durable cloth, nylon, polyester, plastic, or any appropriate combination thereof. The securing mechanism 305 is attached by means described above (sewn with nylon, polyester or a poly-cotton thread but can also be attached by any adhesive, sonic welding, rivets or mechanical fasteners that one of ordinary skill in the art would recognize may be used for this purpose) to the back of the compartment 108 leaving a sufficient passageway slightly larger than the retrieval device so that the retrieval device may slide between the back of the compartment 108 and the securing mechanism 305 that holds the retrieval device in place. In certain embodiments, the retrieval device is in the center of the compartment although the nature of the personal item to be stored may make it preferable for the retrieval device be placed at another location.

The retrieval device has support 301 that is secured to the loop or molded tab 104 and in some embodiments a joiner section 306 by an attachment means described above. The joiner section 306 and the support 301 could be made from leather, suede, synthetic material, Elastomer, durable cloth, nylon, polyester, plastic, or any appropriate combination thereof. The portion of the support 301 towards the front of the compartment may be attached to the inside surface of the front panel of the compartment 105 near the top by one of the attachment means described above. However, the support 301 does not have to be secured to the front of the compartment in order for the retrieval device to function properly. A result of having the support secured to the joiner 306 and/or loop or molded tab 104 and then attached to the front of the compartment is that the support forms a rounded bottom that the personal item received into the compartment rests on in addition to the bottom formed of Aerospacer Nylon in this embodiment. The support 301 holds the bottom of the personal item and secures it in the compartment along with a ribbon 302 and elastic tape 303.

Attached to the bottom of the support 301 towards the back of the compartment is the ribbon 302 attached at a point approximately half of the distance of the support from end to end in this embodiment. Any suitable material can be used in place of the ribbon such as grosgrain, polyester ribbons, nylon ribbons, and/or rayon and cotton blend ribbons. This ribbon 302 should preferably be made of a material that is relatively stiff because its acts as a stop for the retrieval device to prevent overextension.

Attached to the back of the hook approximately one half of the distance from the ribbon 302 to the ring 104 is an elastic tape 303 in this embodiment. The elastic tape can be made of any suitable material including any elastic tapes, elastic bindings, or other elastomers. This elastic tape 303 functions to retract the retrieval device upon release of the loop or molded tab 104 after the personal item has been retrieved from the compartment or placed in the compartment.

FIG. 4 depicts the device in the extended state according to certain embodiments. The loop 104 is lifted in order to remove the personal item from the compartment for retrieval or it may be used to insert the personal device into the compartment. The support 301 supports the bottom of the item while temporarily suspended for removal or insertion. When the retrieval device is lifted using the molded tab or loop 104, the elastic tape 303 is put under tension. The ribbon 302 prevents over-extension of the device. When the hook is released, the retrieval device returns to its rest position as the elastic tape 303 retracts to its resting state depicted in FIG. 3.

Figure 5:
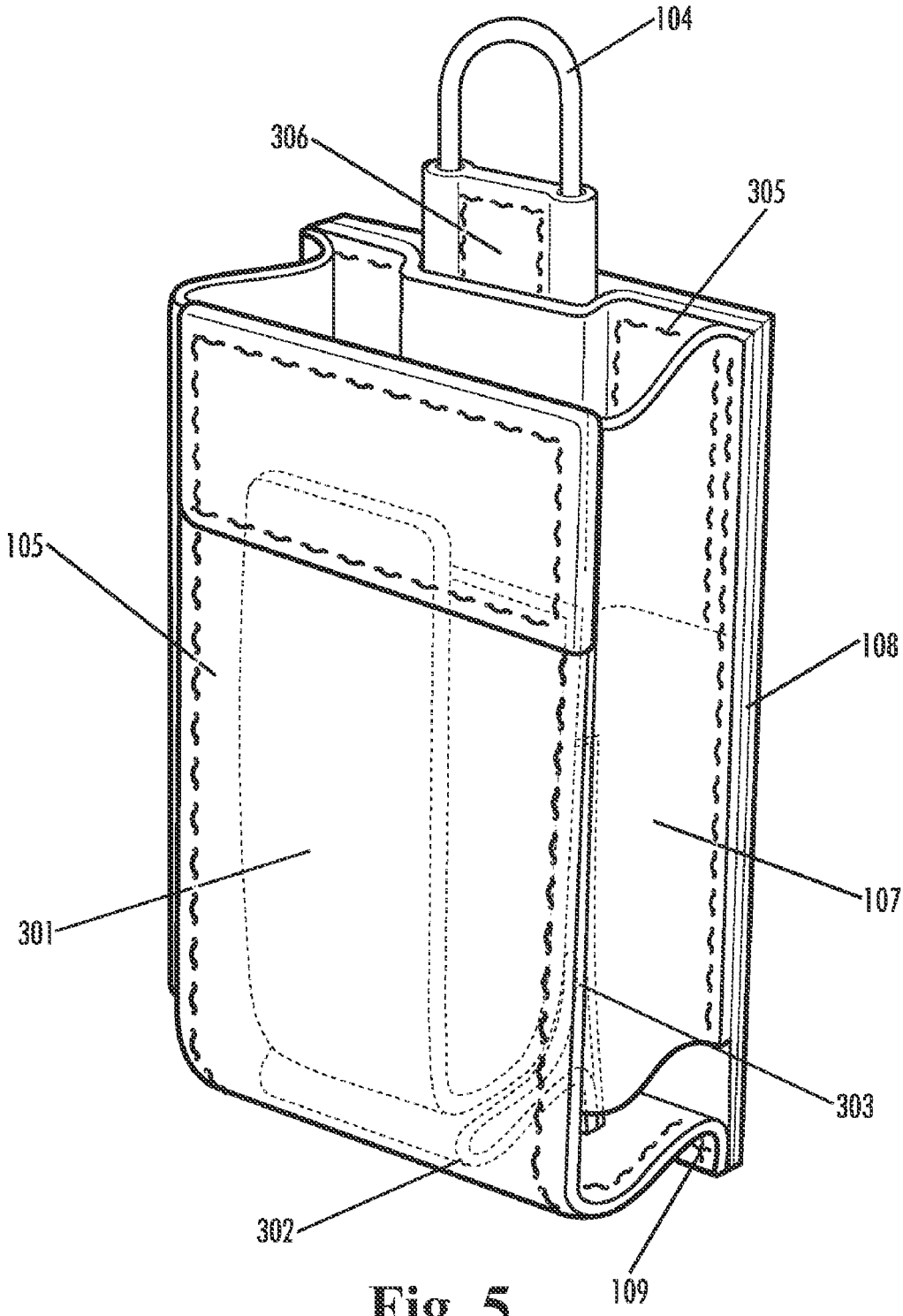
FIG. 5 is a front view of a personal organizer compartment in a relaxed state according to certain embodiments of the invention.

FIG. 5 depicts the complete compartment and retrieval device in a relaxed state according to certain embodiments.

Figure 6:
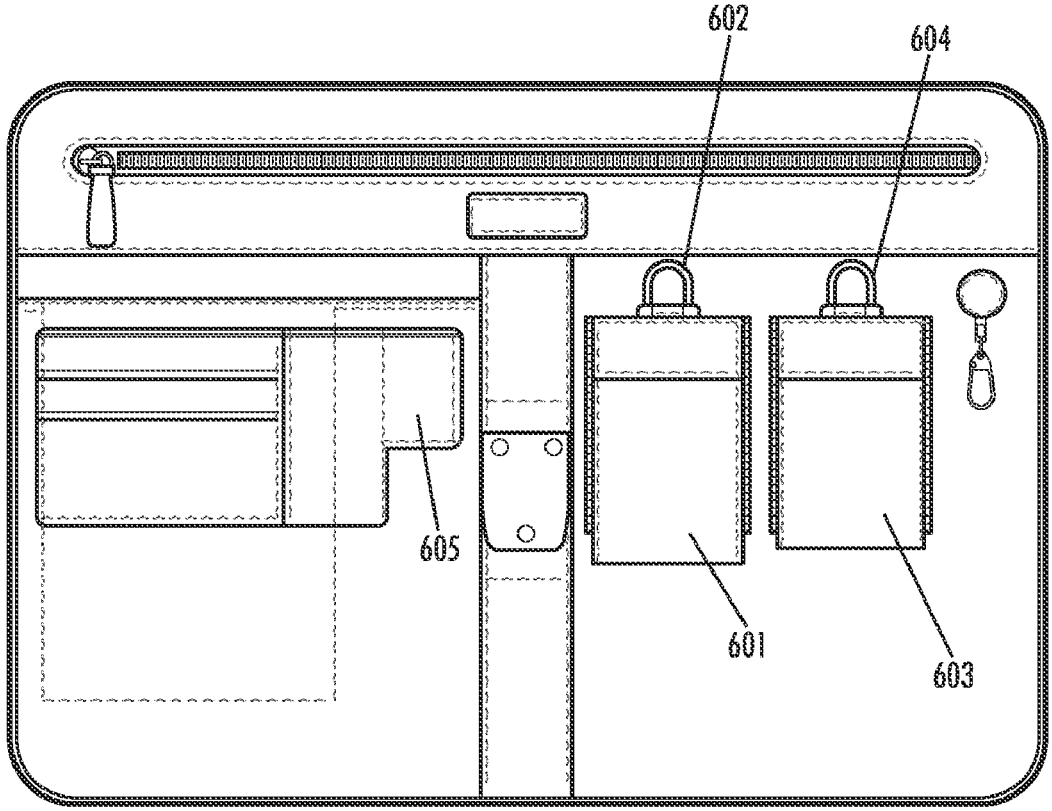
FIG. 6 is a front view of a personal organizer compartment in a briefcase according to certain embodiments of the invention.

FIG. 6 depicts the embodiment of the retrieval device as compartments in a briefcase. A larger compartment 601 and retrieval device 602 can be used for a Blackberry® while a smaller compartment 603 and retrieval device 604 can be used for a cell phone or IPod®. An even smaller compartment 605 can be used for a computer memory device such as a USB device. Even though the computer memory device compartment does not have a molded tab or loop, that is not meant to suggest that the retrieval device's use is not appropriate for devices of that size. The device is intended for use with compartments storing all sizes and shapes of personal or business devices.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments with various modifications as required to suit the particular use contemplated. Alternative embodiments will become apparent to those skilled in the art to which the present invention pertains without departing from its spirit and scope.

The invention claimed is:

1. An apparatus to facilitate the retrieval of a personal device from a compartment comprising:

a back surface;

a support comprising a tab on one end;

an elastic tape comprising a first end attached to the back surface and a second end attached to the support; and a ribbon comprising a first end attached to the elastic tape and a second end attached to the support;

wherein the support can be extended causing the elastic tape to stretch until the ribbon is fully extended preventing further extension of the support.

2. The apparatus of claim 1 wherein the compartment is rectangular, oblong, or square.

3. The apparatus of claim 1 wherein the elastic tape comprises elastic bindings or elastomers.

4. The apparatus of claim 1 wherein the ribbon comprises grosgrain, polyester, nylon, rayon, or cotton blend.

5. The apparatus of claim 1 wherein the support comprises leather, Elastomer, nylon, or polyester.

6. The apparatus of claim 1 wherein the tab is formed into a loop.

7. The apparatus of claim 1 wherein the pocket is attached to a briefcase.

8. The apparatus of claim 1 wherein the pocket is included in a handbag.

9. An apparatus to facilitate the retrieval of a personal device from a pocket comprising:

a back surface;

a support comprising a tab on one end;

an elastic tape comprising a first end attached to the back surface and a second end attached to the support; and a ribbon comprising a first end attached to the elastic tape and a second end attached to the support;

wherein the support can be extended causing the elastic tape to stretch until the ribbon is fully extended preventing further extension of the support.

10. The apparatus of claim 9 wherein the compartment is rectangular, oblong, or square.

11. The apparatus of claim 9 wherein the elastic tape comprises elastic bindings or elastomers.

12. The apparatus of claim 9 wherein the ribbon comprises grosgrain, polyester, nylon, rayon, or cotton blend.

13. The apparatus of claim 9 wherein the support comprises leather, Elastomer, nylon, or polyester.

14. The apparatus of claim 9 wherein the tab is formed into a loop.

15. The apparatus of claim 9 wherein the pocket is attached to a briefcase.

16. The apparatus of claim 9 wherein the pocket is included in a handbag.

* * * * *